United States Patent [19]

Reber

[11] Patent Number: 4,703,594

[45] Date of Patent: Nov. 3, 1987

[54] SPHERICAL BUILDING STRUCTURE

[76] Inventor: Dwight E. Reber, 12122 Fry Rd. NE., Aurora, Oreg. 97002

[21] Appl. No.: 854,520

[22] Filed: Apr. 22, 1986

[51] Int. Cl.[4] ..... E04B 1/32

[52] U.S. Cl. ..... 52/81; 403/172; 52/741; 52/DIG. 10

[58] Field of Search ..... 52/80, 81, 82, 83, DIG. 10, 52/141; 403/172, 176, 170

[56] References Cited

U.S. PATENT DOCUMENTS 2,411,651 11/1946 Darby ..... 52/82
2,670,818 3/1954 Hacker ..... 52/82

FOREIGN PATENT DOCUMENTS 663912 12/1951 United Kingdom ..... 52/82
900902 7/1962 United Kingdom ..... 52/81
2051918 1/1981 United Kingdom ..... 52/DIG. 10

*Primary Examiner*—James L. Ridgill, Jr.
*Attorney, Agent, or Firm*—James D. Givnan, Jr.

[57] ABSTRACT

Building construction using pentagonal and hexagonal concavo-convex components joined by connectors into which the rod ends of the building components are inset and positioned in a diverging manner. The connectors are apertured to receive fasteners which serve to temporarily attach forms to the building components in a spaced manner. A column supports an uppermost pentagonal form as well as floor joists. The forms define two sets of openings for form securement to either equilateral or isosceles triangular areas of the hexagonal and pentagonal building components.

6 Claims, 8 Drawing Figures

SPHERICAL BUILDING STRUCTURE

BACKGROUND OF THE INVENTION

The present invention pertains generally to building construction and particularly to such construction of hemispherical shape.

In the prior art are many types of dome construction including spherical structures such as that shown in U.S. Pat. No. 2,978,074 wherein beam members are formed on a radius and joined at their ends by connectors of spool-like configuration. The building structure uses pentagonally shaped components with each pentagon subdivided into five equal isosceles triangles. The apices of the triangles are joined by a common spool-shaped connector. A covering of the dome is comprised of triangular panels secured to the beam members by sealing strips. One use disclosed for such a structure is as a radome. The connector is not adapted to support additional loads beyond those imparted by the curved beam members.

U.S. Pat. No. 2,918,992 discloses a dome structure using hexagonal and pentagonal components.

U.S. Pat. No. 4,012,872 discloses a geodesic dome using pentagons and hexagons with connectors adapted to receive five or six frame components.

U.S. Pat. No. 3,810,336 is of interest in that it shows the use of both pentagonal and hexagonal components in a geodesic dome.

U.S. Pat. No. 3,380,203 shows great circle frame work members which receive horizontally disposed, small circles and adapted to receive an exterior of reinforced concrete. A modified form has furring strip and internal panel members permanently secured to the curved form members.

In general, the known prior art dome structures intended for use as buildings, attempt to benefit from the well-known advantages of dome construction but fall short of wide acceptance by the public for one reason or another. One suspected reason for such limited acceptance is the problems encountered in dome erection. A further drawback to known dome structures is the multitude of components which contributes to manufacturing and erection costs.

SUMMARY OF THE PRESENT INVENTION

The present invention is embodied in a dome building structure utilizing economical, readily assembled components yet providing a structure of extraordinary strength.

Major components of the present building structure lend themselves to preassembly using high volume techniques at a plant site. The components may be constructed from readily available material such as concrete reinforcing steel termed rebar. Such material may be rolled to the desired radius, or steel tubing formed on a radius should tubing be preferred over solid rod for some structures. Connectors serve to position elongate curved members in radiating fashion during preassembly of the components and, during building erection, serve to join pentagonally and hexagonally shaped major components. The connectors also serve to receive fastener means which carry forms in a temporary manner. Forms used with the present structure may be adapted for use both with isosceles triangles of the pentagon components and equilateral triangles of the subdivided hexagonal components.

The forms used may be of compound curvature provided with two sets of fastener receiving bores to permit form use on either pentagonal or hexagonal components. Construction of the present building structure is facilitated by a central column or post which may be subsequently removed or left in place as a joist support or a hoist beam support.

Important objectives of the present building structure is the provision of a structure using relatively low cost, preassembled, components which are joined at the construction site using connectors which subsequently serve to support form members; the provision of a dome building structure which utilizes a form member adapted for temporary securement to different size and shape triangular areas of both the pentagon and hexagon building components; the provision of a dome building structure capable of withstanding extraordinary live and dead loads; the provision of a building structure of low cost per square foot by reason of materials and construction techniques.

DETAILED DESCRIPTION OF THE PREFERRED EMBODIMENTS

Figure 1:
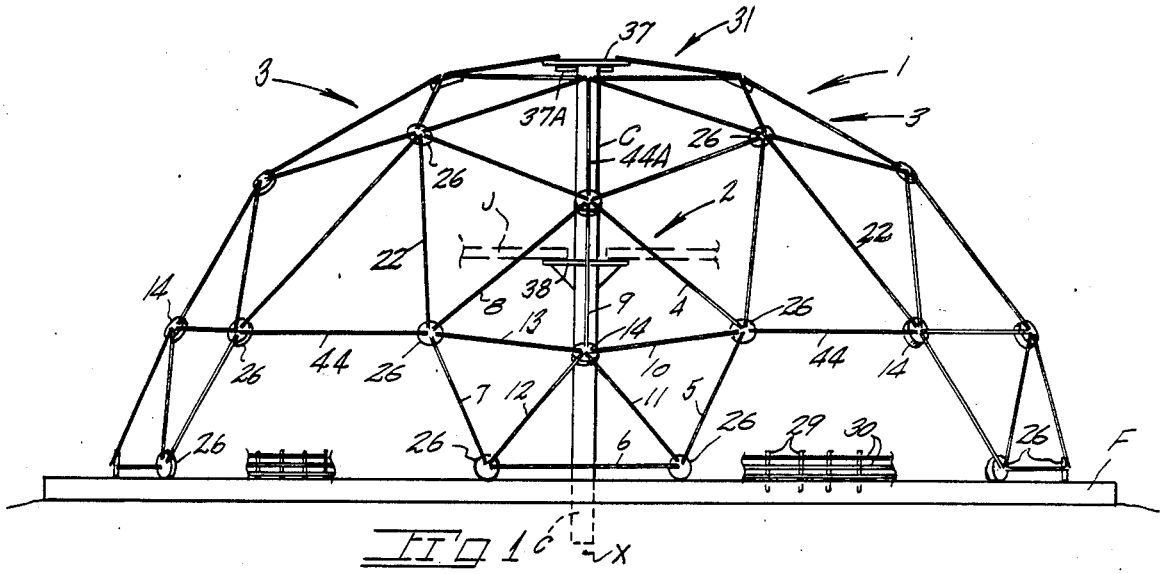
FIG. 1 is a side elevational view of a building structure embodying the present invention.
Figure 2:
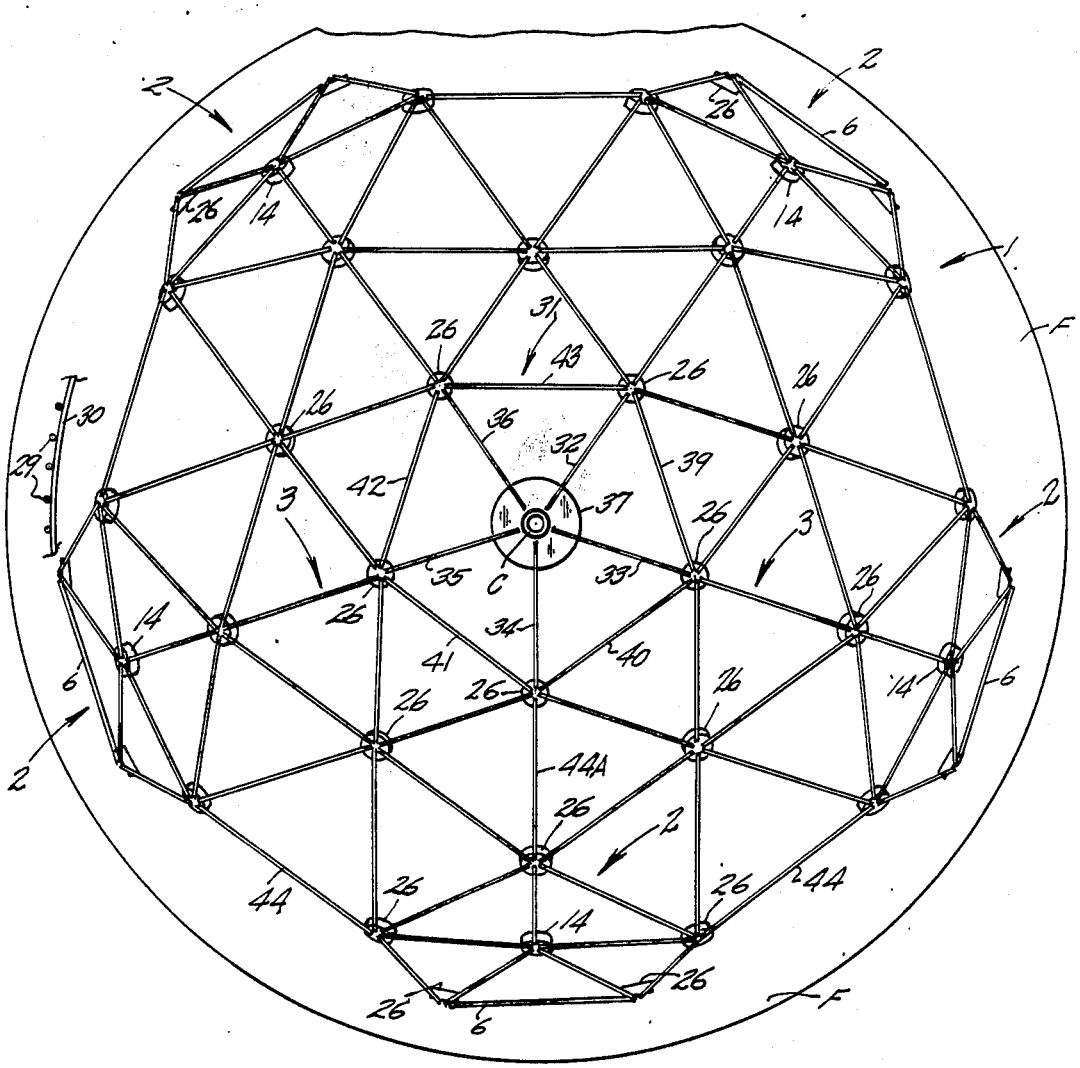
FIG. 2 is a top plan view of FIG. 1.

With continuing attention to the drawings wherein applied reference numerals indicate parts similarly hereinafter identified, the reference numeral 1 indicates generally a building structure of dome or hemispherical shape.

Figure 4:
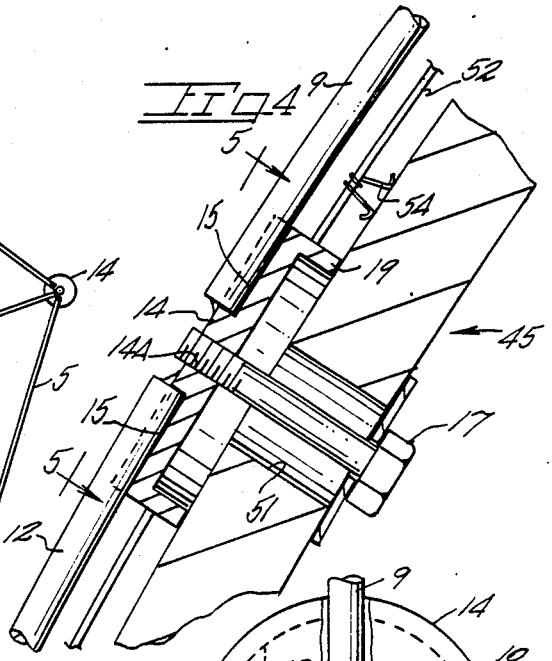
FIG. 4 is a vertical sectional view taken along line 4—4 of FIG. 3.
Figure 5:
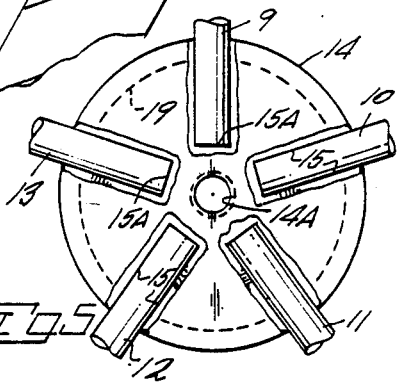
FIG. 5 is an elevational view of connector means taken along line 5—5 of FIG. 4.

The building structure is comprised of upright pentagonally shaped perimeter components indicated generally at 2 and hexagonally shaped building components indicated generally at 3. With particular attention to the pentagonal components 2, the same includes side members 4, 5, 6, 7 and 8. Internal members at 9, 10, 11, 12 and 13 divide each pentagon into five isosceles triangles. Said side members are uniformly curved and formed on a radius from a center indicated at X located below a circular foundation with a footing at F. The curved pentagon members are joined at their inner ends by connector means 14 as best shown in FIG. 4 and which is formed with channels 15 within which the component members are inset with their ends abutting the channel end walls at 15A. Additional connector means joins each internal member with a pair of side members and with later described hexagonal component members. The connector means 14 additionally defines a central bore 14A which is threaded for the reception of a headed fastener 17 also used in conjunction with later described building forms. A skirt portion 19 of the connector means serves to space later described forms from the pentagonal component.

Figure 6:
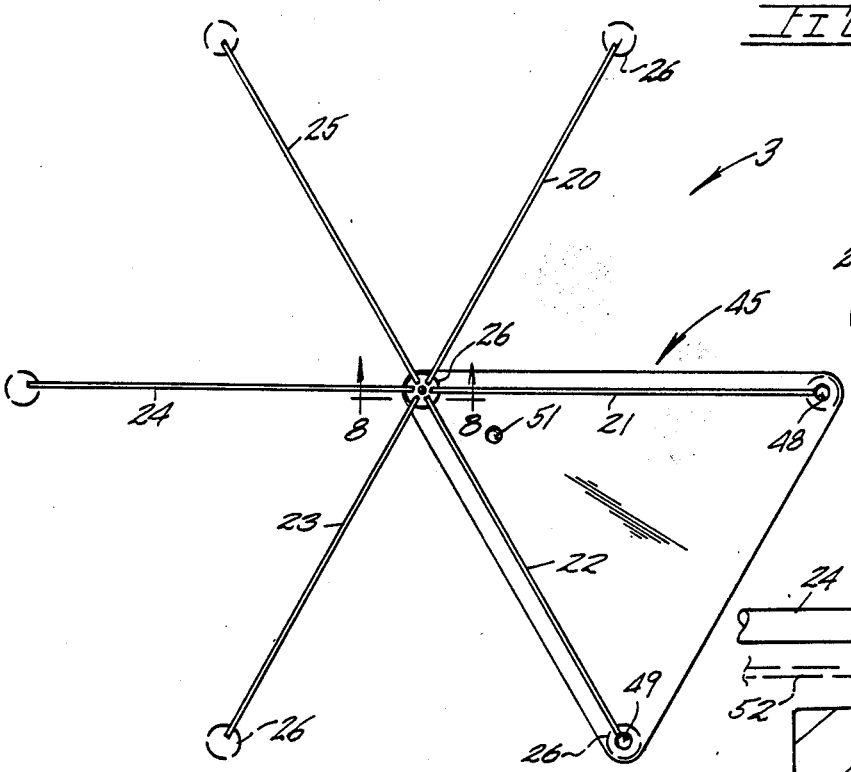
FIG. 6 is an elevational view of a hexagonal building component with a form member attached.
Figure 7:
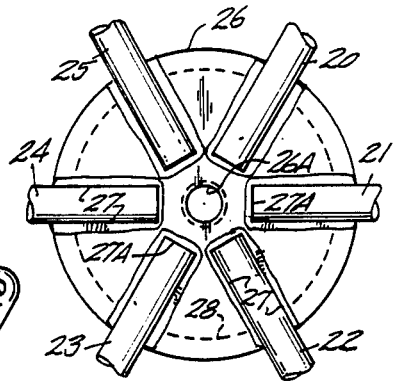
FIG. 7 is an enlarged view of connector means used in the hexagonal building component.
Figure 8:
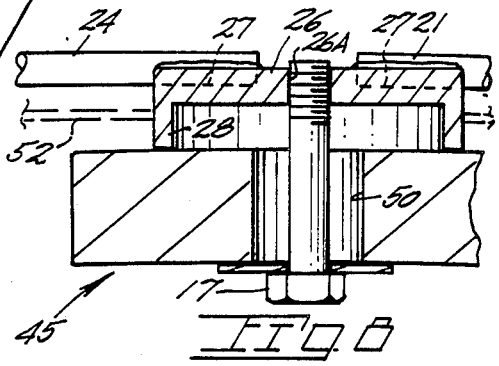
FIG. 8 is a sectional view of connector means taken approximately along line 8—8 of FIG. 6.

The hexagonal, concavo-convex building component at 3, best shown in FIG. 6, includes radiating elongate curved members at 20, 21, 22, 23, 24 and 25 which are secured at their proximate ends to connector means indicated at 26. Connector means 26 is similar to connector means 14 with the exception that it defines six channels at 27 for the reception and securement of six elongate members. Channel end walls are at 27A. The term hexagonal with reference to component 3 is not used in the true geometric sense as the side members for the hexagonal members are in actuality the side members of adjacent pentagons. The connector means 26 is of circular configuration has an annular skirt 28 extending about its periphery which skirt serves as a spacer to position later described form members. The connector means is apertured at 26A to receive a headed fastener 17.

Figure 3:
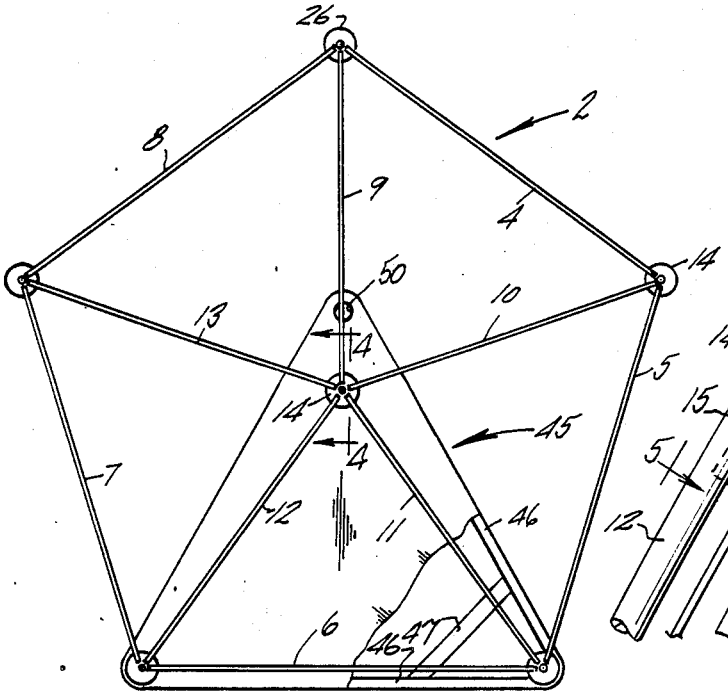
FIG. 3 is an elevational view of a pentagonal component of the building structure with a form member attached.

As viewed in FIGS. 1 and 3 the lowermost pair of connector means of each pentagonal component 2 are secured to steel reinforcing projecting upwardly from concrete footing F. One suitable reinforcing steel arrangement utilizes angularly bent rebar segments 29 having an upright portion extending above the footing surface. Curved lengths of rebar 30 interconnect with upright portions of angle shaped rebar. The aforementioned lowermost pairs of connector means 14 of each pentagonal component are secured as by welding to the curved lengths of rebar 30.

A centrally disposed column C within the structure has a buried lower end segment and serves to directly support, during erection and later, if desired, a uppermost pentagonal component indicated generally at 31. Said uppermost central pentagonal component differs from the earlier described pentagonal components in that its internal members at 32, 33, 34, 35 and 36 terminate inwardly in securement with a first or central disk 37 which is positionable and fixable near the upper end of column C and held in place thereon as by a column inserted rod 37A. Top pentagonal component 31 has side members at 39, 40, 41, 42 and 43 with the internal and side members being joined by connector means 14 as described earlier. A second disk at 38 is fixed on column C and may be used to support the inner ends of floor joists of a building structure second floor while the outer ends of the radiating floor joists at J are carried by hangers suitably attached to dome structure.

Tie rod components at 44 tie the lateral extremities of adjacent pentagonal components and serve to space and brace said components during building erection. Additional tie rod components are at 44A.

In FIGS. 3 and 6, a form is indicated generally at 45 which is of compound curvature so as to be concentric with both the triangular portions of the pentagonal and the hexagonal building components. The form is of rigid, reinforced fiberglass construction having curved side rails as at 46 internally braced as at 47. The form is an equilateral triangle and defines a first set of openings 48, 49 and 50 one each at each apex for the inserted reception of the fasteners 17 associated with each of the earlier described connector means. Accordingly, form 45 may be temporarily fastened interiorly to any hexagonal building component in the manner shown in FIG. 6. The skirt portion 28 of the connector means 26 assures inward spacing of the forms outermost surface from the hexagonal component to provide an area for the reception of cementious material such as concrete in a triangular area of the building component.

The form has a second set of openings comprised of previously mentioned openings 48 and 49 and a new opening 51 therein which permit temporary installation of the form on the pentagonal building components which are subdivided into isosceles triangles. Said second set of openings includes the two earlier mentioned apical located openings 48 and 49 and the additional or new opening at 51. The fasteners 17, when inserted through the second set of openings, serve to secure the form to triangular areas of the pentagonal areas of the building component as shown in FIG. 3. Form 45 is reinforced at each corner opening by bent flat iron members having a flat iron bridge member welded therein. The openings in the form are oversized to permit compensation for connector spacing variances.

For the sake of avoiding overstressing of the building components, the installation of form members 45 and the application of cementious material is done incrementally at spaced apart locations about the dome structure. The layer of cementious material is reinforced internally by welded wire fabric 52 held in place and offset by wire spacers as at 54.

The method of construction includes the steps of installing, in a removable manner, column C at the foundation center with the column provided with disk 37 located at the column upper end with the uppermost pentagonal component 31 carried by said disk. The pentagonal components 2 are installed in place, about outer margin of the footing and supported by the rebar at 29 and 30 with the components spaced apart and braced by tie rods 44A and 44. The hexagonal components 3 are then attached, as by welding, to the connector means 14 on the pentagonal components 2 and 31. A second disk 38 may be located at column C as a support for the inner ends of floor joists for a second floor or, if the building is to be used for commercial purposes, the column C may support the inner end of a hoist carrYing beam. The steel and wire fabric reinforced shell is of requisite strength to provide a suitable attachment joint for beam or joist hangers. In some uses, column C will be removed from the finished structure.

Entry to the structure may be via a barrel vaulted entry (not shown) preferably constructed from a lattice work of rebar and welded wire fabric reinforced concrete when the structure is for other than residential purposes. For residential uses, the entry may be of considerably less size. Vaulted entries will join the structure intermediate pentagonal building components 2.

While I have shown but one embodiment of the invention, it will be apparent to those skilled in the art that the invention may be embodied still otherwise without departing from the spirit and scope of the invention.

Having thus described the invention, what is claimed and desired to be secured in a Letters Patent is:

1. A spherical building comprising, building components including upright pentagonal perimeter components and a generally horizontal central pentagonal component and each including first connector means centrally disposed within each component, elongate curved members attached at their inner ends to said first connector means and extending in radiating fashion therefrom, some of said building components including side members, said central pentagonal component additionally including a central disk adapted for support by a column at the center of the building, second connector means carried at the outer end of some of said elongate members and receiving the outer ends of other elongate members and said side members in a permanent manner, fastener means insertably engageable with said first and second connector means and each adapted to engage and retain a detachable concavo-convex form member in spaced relationship to said components, and said connector means each defining channels in which said outer ends of said elongate members are fixedly mounted and having a skirt to space said form member from said elongate curved members.

2. The spherical building claimed in claim 1 wherein the channels of said connectors are partially defined by channel end wall against which abut the ends of said elongate curved members for the transmission of loads through said connectors in an optimum manner.

3. The spherical building claimed in claim 1 wherein said building components are of concavo-convex shape.

4. The building structure claimed in claim 3 wherein said connector means each defines a threaded bore for the reception of said fastener means.

5. A method of spherical building construction for the formation of a dome shaped structure, said method comprising the steps of, erecting a vertical column, mounting an uppermost pentagonally shaped building component adjacent the upper end of said column in a symmetrical manner, positioning pentagonally shaped perimeter building components in an upright spaced apart manner in a circular array on a foundation all uniformly spaced from said column, interconnecting in a temporary manner said pentagonally shaped perimeter building components and said uppermost pentagonally shaped building component by tie rods, an positioning and securing hexgonally shaped building components to the circular array of said pentagonally shaped perimeter building components and to said uppermost pentagonally shaped building component to form a dome structure.

6. The method claimed in claim 5 additionally including the added step of temporarily attaching a form of triangular shape to a portion of the pentagonally or hexagonally shaped building components at spaced apart locations on the structure for the application of cementious material at said apart locations on the structure to prevent asymmetrical loading of the structure during construction.

* * * * *